US005365907A

United States Patent [19]

Dietrich et al.

[11] Patent Number: 5,365,907

[45] Date of Patent: Nov. 22, 1994

[54] CYLINDER HEAD FOR AN INTERNAL COMBUSTION ENGINE WITH FUEL INJECTION

[75] Inventors: Markus Dietrich, Oberrot; Walter Aupperle, Korb, both of Germany

[73] Assignee: Mercedes-Benz AG, Stuttgart, Germany

[21] Appl. No.: 141,525

[22] Filed: Oct. 27, 1993

[30] Foreign Application Priority Data

Nov. 21, 1992 [DE] Germany ..... 4239173

[51] Int. Cl.[5] ..... F02M 55/02

[52] U.S. Cl. ..... 123/470; 123/468; 285/13

[58] Field of Search ..... 123/470, 456, 468, 469; 285/13, 14, 93

[56] References Cited

U.S. PATENT DOCUMENTS

| | | | |
|---|---|---|---|
| 3,431,895 | 3/1969 | Bailey | 123/470 |
| 3,845,748 | 10/1974 | Eisenberg | 123/470 |
| 4,384,557 | 5/1983 | Johnson | 123/468 |
| 4,445,713 | 5/1984 | Bruning | 123/469 |
| 4,485,790 | 12/1984 | Nishimura | 123/470 |
| 4,665,876 | 5/1987 | Hashimoto | 123/468 |
| 4,938,193 | 7/1990 | Raufeisen | 123/470 |

FOREIGN PATENT DOCUMENTS

| | | | |
|---|---|---|---|
| 4140668 | 7/1992 | Germany | 123/469 |

*Primary Examiner*—Carl S. Miller
*Attorney, Agent, or Firm*—Klaus J. Bach

[57] ABSTRACT

In a cylinder head for a fuel injected internal combustion engine in which a nozzle holder with a fuel injection nozzle is mounted and engaged by a pressure tube disposed in a cylindrical recess, the pressure tube is axially forced into firm engagement with the nozzle holder by a hollow compression screw through which the pressure tube extends so that its free end projects outwardly and an injection pipe is mounted onto the free end of the pressure tube by means of a union nut for sealing the injection pipe to the pressure tube.

5 Claims, 1 Drawing Sheet

1
2
3
4
5
6
7
8
9
10
11
12
13
14
15
16
17
18
18a
18b
19
20
21
22
23
24
25
26
27
28
29
II

CYLINDER HEAD FOR AN INTERNAL COMBUSTION ENGINE WITH FUEL INJECTION

BACKGROUND OF THE INVENTION

The invention relates to a cylinder head for an internal combustion engine with fuel injection wherein a fuel pipe is connected to a pressure tube for supplying fuel under pressure to an injection nozzle.

Such a cylinder head is known from DE 31 28 523 C2 in which a thick-walled pressure tube is disposed in a cylindrical recess leading to the nozzle holder. The pressure tube is pressed onto a sealing seat on the nozzle holder by a compression nut, which surrounds an injection pipe originating from the injection pump and engages a flange structure firmly connected to the injection pipe.

Upon removal of the injection pipe the high pressure seal on the nozzle holder is necessarily also loosened in this arrangement and this can lead to sealing problems on reassembly of the injection pipe.

It is therefore the object of the invention to provide a conduit connection which is easy to assemble and which eliminates sealing problems at the high pressure seal connection between the pressure tube and the nozzle holder upon loosening and remounting of the injection pipe connection at the cylinder head.

SUMMARY OF THE INVENTION

In a cylinder head for a fuel injected internal combustion engine in which a nozzle holder with a fuel injection nozzle is mounted and engaged by a pressure tube disposed in a cylindrical recess, the pressure tube is axially forced into firm engagement with the nozzle holder by a hollow compression screw through which the pressure tube extends so that its free end projects outwardly and an injection pipe is mounted onto the free end of the pressure tube by means of a union nut for sealing the injection pipe to the pressure tube.

Assembly and dismantling of the injection pipe and pressure tube are simplified by the special arrangement and configuration of the high pressure pipe connection because the pressure tube remains firmly mounted in the cylinder head when the fuel pipe is disconnected. A further advantage lies in the fact that reliable sealing at the nozzle holder continues to be ensured independent of the dismantling of the injection pipe. In addition, the design according to the invention permits leak-testing on the pre-assembled cylinder head.

DESCRIPTION OF A PREFERRED EMBODIMENT

Figures 1, 2:
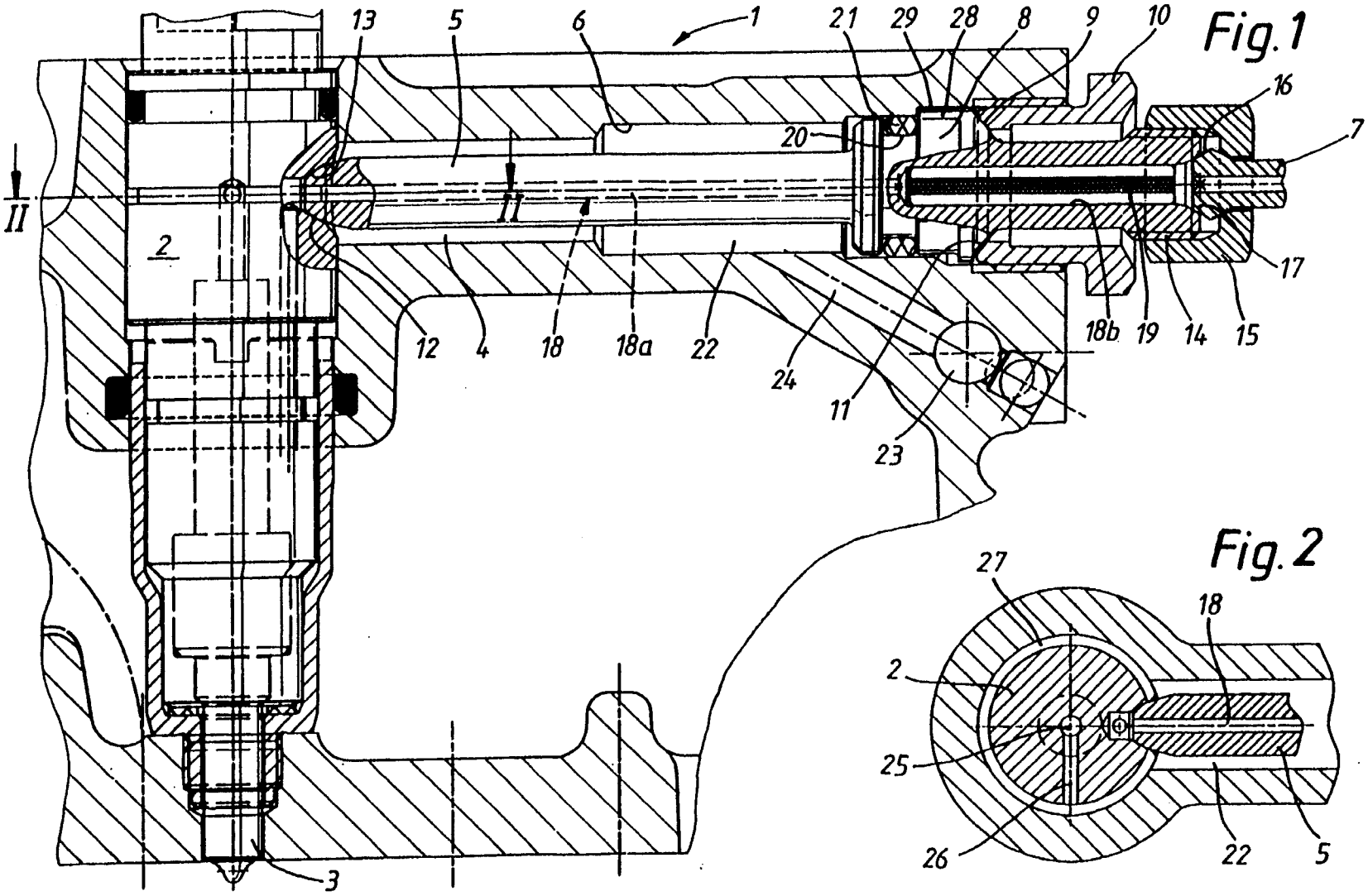
FIG. 1 is a partial cross-sectional view of a cylinder head with fuel injector according to the invention.
FIG. 2 is a cross-sectional view along line II—II of FIG. 1.

A nozzle holder 2 with a fuel injection nozzle 3 is mounted in the cylinder head 1 of an air-compressing fuel-injected internal combustion engine. A fixed-position, thick-walled pressure tube 5 is also disposed in a cylindrical recess 4 in the cylinder head 1, which recess 4 has a stepped configuration and extends transversely to the nozzle holder 2. The thick-walled pressure tube 5 extends over the full length of the cylindrical recess 4 with a radial distance from the wall 6. The free end of the pressure tube 5 protrudes from the cylinder head 1 and forms a connector for an injection pipe 7 connected to an injection pump (not shown).

The pressure tube 5 is provided with an external collar 8 which has a conical or spherical contact surface 9 at the injection pipe end for engagement by a hollow compression screw 10 screwed into the cylindrical recess 4. The compression screw 10 has, in turn, a conical seating surface 11 corresponding to the contact surface 9 of the pressure tube 5. The conical end surface 12 at the nozzle holder end of the pressure tube 5 is firmly seated by the force of the compression screw 10 so that it seals against a correspondingly configured sealing seat 13 formed at the connection of the nozzle holder 2. The position of the pressure tube 5 is therefore fixed in the cylindrical recess 4 of the cylinder head 1.

The pressure tube 5 protrudes beyond the compression screw 10 and is provided at its outer end with an external thread 14 for a union nut 15 by means of which the injection pipe 7 is sealingly connected to the pressure tube 5. The injection pipe 7 has an enlarged end with a conical end surface 16 which is sealingly engaged by the force of the union nut 15 with a matching seating surface 17 of the pressure tube 5.

The pressure tube 5 has an internal passage 18 which comprises two passage sections, **18*a*, 18*b*, of which the passage section 18*b* at the injection pipe end has a larger diameter and is adapted to accommodate a fuel filter 19**.

Adjacent the collar 8 there is a sealing ring 21 disposed in a groove 20, the sealing ring 21 being sized so as to close and seal the annular intermediate space 22 between the pressure tube and the wall of the recess 4. A leakage fuel or fuel return passage 24 provides for communication between the annular intermediate space 22 which is in communication with a fuel leakage passage in the nozzle holder and a collecting passage 23 in the cylinder head 1.

FIG. 2 shows a leakage fuel path in the nozzle holder 2 which includes a central passage 25 originating from the fuel injection nozzle 3, a radial passage 26 leading outwardly from the central passage 25 and an annular passage 27, which is in communication with the annular intermediate space 22. The conical end surfaces, seating surfaces and sealing surfaces at the nozzle holder and/or injection pipe ends can also, if appropriate, have a spherical configuration.

In addition, an angular position locking arrangement can be provided to prevent rotation of the pressure tube 5 during the assembly of the injection pipe 7. It consists of a radial lug on the pressure tube 5, for example, at the collar 8, and a correspondingly matched groove 29 in the cylindrical recess or of a cylindrical pin in the cylinder head and a flat or axial groove machined into the pressure tube.

What is claimed is:

1. A cylinder head for a fuel injected internal combustion engine comprising a nozzle holder with a fuel injection nozzle mounted in said cylinder head, said cylinder head further having a cylindrical recess accommodating a pressure tube, which extends to said nozzle holder and is engaged therewith and which has a conical sealing surface at the nozzle holder end, and said nozzle holder having a matching surface with which said conical surface is in contact, a compression screw mounted in said cylindrical recess at the outer end thereof and engaging said pressure tube and axially clamping it with its remote inner end against said matching contact surface on said nozzle holder for sealingly engaging and appropriately locating said nozzle holder, said pressure tube extending through and outwardly beyond said compression screw, with its free end projecting from the compression screw and provided with a union nut by which an injection pipe is clamped to said pressure tube so as to form a seal therewith, said pressure tube having two passage sections with the section at the free end of said pressure tube adjacent the injection pipe having an increased diameter for accommodating a fuel filter.

2. A cylinder head according to claim 1, wherein said pressure tube has a stepped configuration and is provided with a collar having formed thereon a contact surface engaged by a matching seating surface formed on said compression screw.

3. A cylinder head according to claim 2, wherein the pressure tube has an annular groove formed in its collar with a sealing ring disposed therein in contact with the wall of said cylindrical recess so as to seal said pressure tube in said cylindrical recess.

4. A cylinder head for a fuel injected internal combustion engine comprising a nozzle holder with a fuel injection nozzle mounted in said cylinder head, said cylinder head further having a cylindrical recess accommodating a pressure tube, which extends to said nozzle holder and is engaged therewith and which has a conical sealing surface at the nozzle holder end, and said nozzle holder having a matching surface with which said conical surface is in contact, a compression screw mounted in said cylindrical recess at the outer end thereof and engaging said pressure tube and axially clamping it with its remote inner end against said matching contact surface on said nozzle holder for sealingly engaging and appropriately locating said nozzle holder, said pressure tube extending through and outwardly beyond said compression screw, with its free end projecting from the compression screw and provided with a union nut by which an injection pipe is clamped to said pressure tube so as to form a seal therewith, said cylindrical recess having a diameter larger than said pressure tube so as to form an annular intermediate space around said pressure tube which is in communication with a fuel leakage passage originating from said injection nozzle, and said cylinder head including a leakage fuel collection passage and a leakage fuel connecting passage extending between said leakage fuel collection passage and said annular intermediate space so as to provide for communication between said collection passage and said annular intermediate space for the collection of leakage fuel from said injection nozzle.

5. A cylinder head according to claim 4, wherein said pressure tube has a stepped configuration and is provided with a collar having formed thereon a contact surface engaged by a matching seating surface formed on said compression screw and said leakage fuel connecting passage is in communication with the portion of said annular intermediate space between the collar of said pressure tube and said nozzle holder.

* * * * *